United States Patent [19]

Thomas

[11] Patent Number: 5,069,455

[45] Date of Patent: Dec. 3, 1991

[54] GOLF PUTTING TRAINER

[76] Inventor: William F. Thomas, 5825 Via Coiba, Riverside, Calif. 92506

[21] Appl. No.: 423,666

[22] Filed: Oct. 16, 1989

Related U.S. Application Data

[63] Continuation-in-part of Ser. No. 229,700, Aug. 8, 1988, abandoned.

[51] Int. Cl.[5] ..... A63B 69/36

[52] U.S. Cl. ..... 273/176 H; 273/DIG. 31; 273/176 F; 273/176 E

[58] Field of Search ..... 273/176 R, 176 J, 177 R, 273/178 R, 178 B, 183 A, 195 R, 195 A, 195 B, DIG. 31, DIG. 13, 109, 113, 115

[56] References Cited

U.S. PATENT DOCUMENTS

| | | | |
|---|---|---|---|
| 3,601,407 | 8/1971 | Lorrance | 273/176 H |
| 3,727,917 | 4/1973 | MacLean | 273/176 H |
| 3,735,988 | 5/1973 | Palmer et al. | 273/176 H |
| 3,831,949 | 8/1974 | Henning | 273/176 H |
| 3,862,760 | 1/1975 | Davis | 273/176 E |
| 3,870,314 | 3/1975 | Bertucci | 273/195 R |
| 4,108,440 | 8/1978 | Delaplaine | 273/176 H |
| 4,211,417 | 7/1980 | Brown | 273/176 H |
| 4,222,568 | 9/1980 | Russo | 273/178 B X |
| 4,240,637 | 12/1980 | Cross et al. | 273/176 H |
| 4,805,912 | 2/1989 | Hickman | 273/176 FA X |

*Primary Examiner*—Edward M. Coven
*Assistant Examiner*—Sebastiano Passaniti
*Attorney, Agent, or Firm*—David L. Tingey

[57] ABSTRACT

A golf putting surface is provided that is adjustable in height at selected locations within the surface within a continuum of vertical positions by means of a plurality of height adjustment mechanisms. The height adjustment mechanisms are themselves adjustably located horizontally along substantially the entire perimeter of the surface to produce numerous surfaces with differing undulation. The surface is covered with one of a selection of interchangeable surface materials of differing friction and texture to use in combination with the undulating surface to simulate different playing conditions.

6 Claims, 9 Drawing Sheets

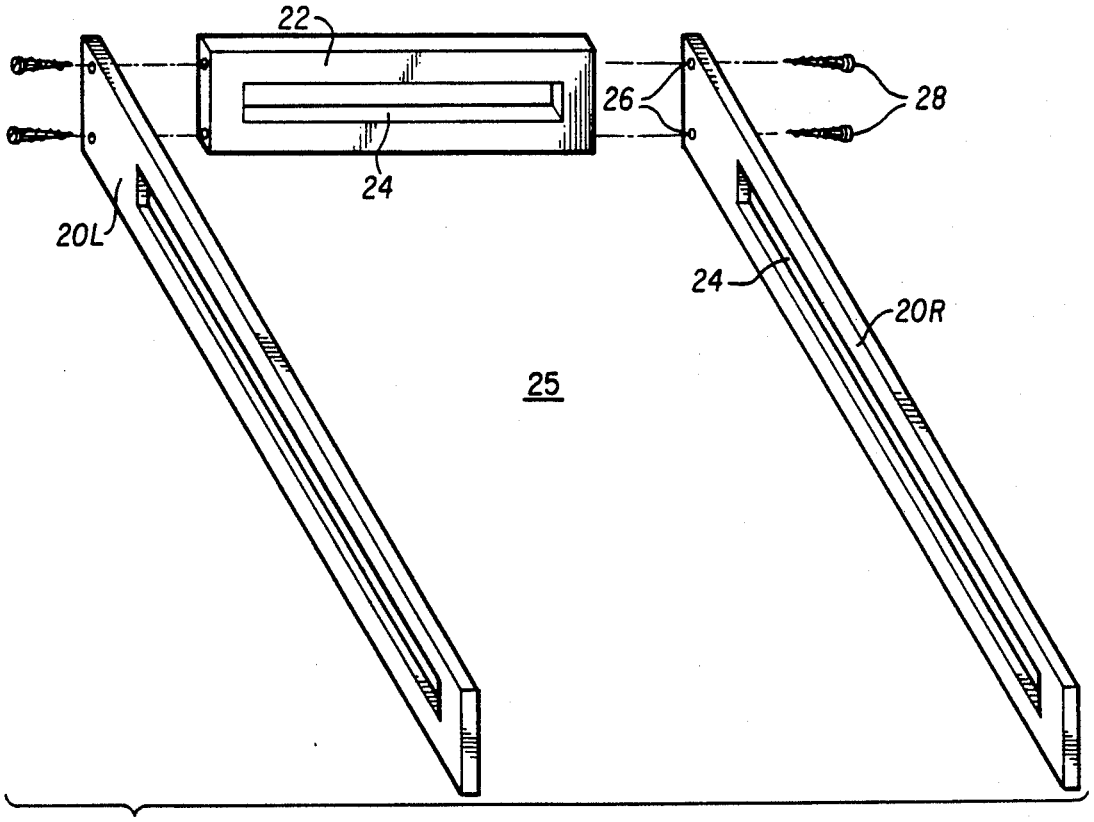
FIG. 1
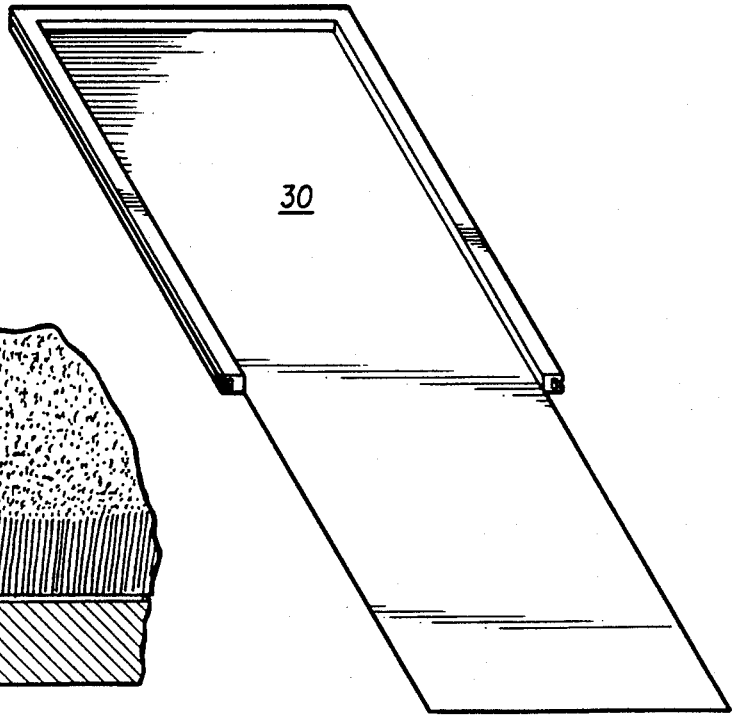
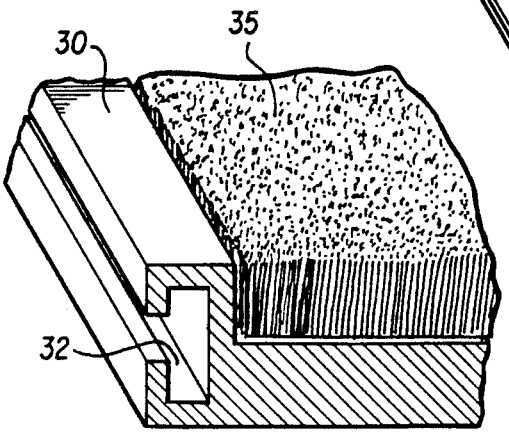
FIG. 3
FIG. 2

GOLF PUTTING TRAINER

This application is a continuation in part of application Ser. No. 07/229,700, filed Aug. 8, 1988, now abandoned.

BACKGROUND OF THE INVENTION

This invention relates to artificial golf putting surfaces for practicing putting, and specifically to golf putting surfaces that are adjustable and are replaceable with materials of varying friction and texture to accurately simulate actual playing conditions.

It is already known in the art to have adjustable surfaces golf putting, including planar surfaces adjustable in height at an end and undulating surfaces adjustable in height at fixed positions along the length of the surface. It is also known to have differing playing surfaces. However, it is not heretofore known to have a golf putting surface adjustable in height at numerous positions having height adjustment mechanisms adjustably located horizontally along the perimeter of the surface, and covered with one of a selection of interchangeable surface materials simulating different playing conditions.

OBJECTS OF THE INVENTION

It is the object of the present invention to provide a golf putting surface adjustable in height at numerous positions and height adjustment mechanisms adjustably located horizontally along substantially the entire perimeter of the surface, which height adjustment mechanism can be set in numerous combinations of horizontal and vertical adjustment to represent a multiplicity of undulating surfaces.

Another object is to provide a selection of interchangeable surface materials of differing friction and texture to use in combination with the undulating surface to further simulate different playing conditions.

A final object is to provide a putting practice surface that closely simulates actual playing conditions and is portable and simple to operate.

BRIEF DESCRIPTION OF THE DRAWINGS

FIG. 1 is an exploded perspective view of the base assembly.

FIG. 2 is a perspective view of the surface support body.

FIG. 3 is a perspective view of an enlarged section of the surface support body showing a molded guide at its edge and supporting interchangeable surface turf.

FIG. 13*a* and FIG. 13*b* are a perspective views of the apparatus representing two adjusted positions of the surface.

SUMMARY OF THE INVENTION

Figure 4:
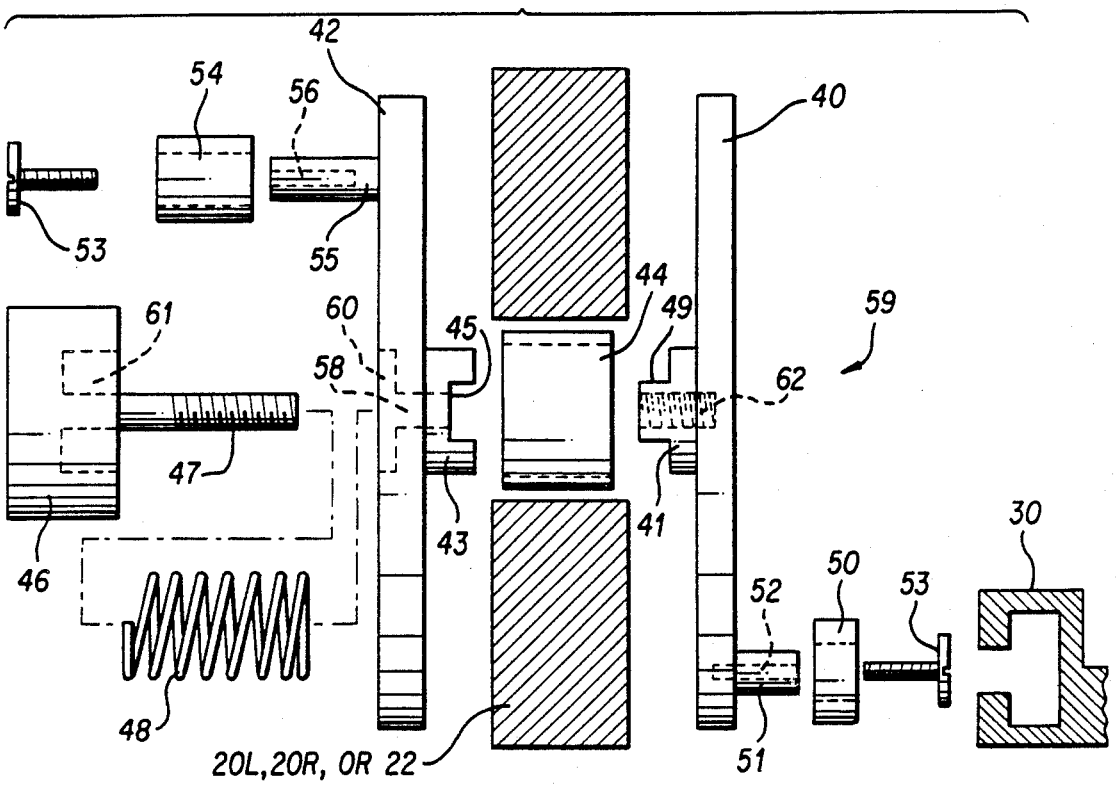
FIG. 4 is an exploded view of the elevation adjustment assembly.
Figure 8:
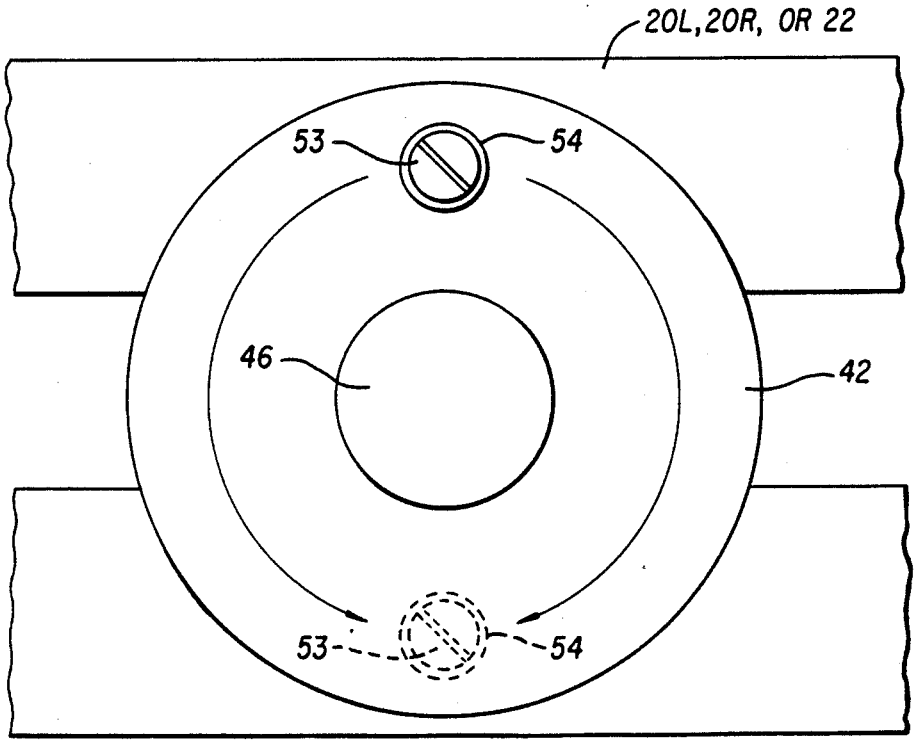
FIG. 8 is a front view of the rotational elevation adjustment device.

The present invention provides a golf putting surface that is adjustable in height at selected locations within the surface. Vertical adjustment is by means of a plurality of height adjustment mechanisms that allow a continuous vertical adjustment within adjustment limits. The height adjustment mechanisms are themselves adjustably located horizontally along substantially the entire perimeter of the surface to allow the user to produce numerous surfaces with differing undulation. The surface is covered with one of a selection of interchangeable surface materials of differing friction and texture to use in combination with the undulating surface to simulate a variety of playing conditions.

DESCRIPTION OF THE PREFERRED EMBODIMENTS

Referring to the figures, in its usual configuration, the golf putting trainer assembly comprises a base assembly 25, a sheet of resilient molded material 30 on top of the base assembly, both of sufficient size to accommodate use by a human being for practicing putting, a plurality of elevation adjustment assemblies 59 attached to the base assembly 25 with the capability of adjustably supporting the sheet of resilient molded material 30, and an interchangeable surface material made 32 of an artificial turf or other suitable material to simulate playing conditions of varying texture and friction. The sheet of resilient molded material 30 is slidably anchored to the elevation adjustment assemblies 59 which enables free horizontal movement of the elevation adjustment assemblies 59 along substantially the entire perimeter of the resilient molded material 30, whereby numerous changes in contour and undulation to said sheet of resilient molded material 30 may be achieved.

FIG. 1 shows the base assembly 25 comprising two spaced-apart base side panels 20L and 20R nominally in parallel and connected by a base end panel 22. Typically, the base side panels with end panel provide a base assembly dimension of 4 feet by 2 feet with a vertical dimension of about 4 inches to facilitate portability and storage. In the alternative, the base could be shaped in almost any form, such as a square, circle, rectangle, triangle, kidney-shape, or any combination of shapes and in any practical size.

As illustrated in FIG. 2, the sheet of resilient molded material 30 is shaped to conform with the base assembly 59 and fits within it on 3 sides, typically extending out of the base assembly 59 at the base assembly end opposite the base end panel 22, perhaps a distance of up to 8 feet. As shown in FIG. 3, the sheet of resilient molded material 30 has a raised channel 32 at its edge, opening toward the base assembly side and end panels and extending around its perimeter. The channel 32 provides a guide for elevation adjustment assemblies 59 which fit into the channel 30 as they are moved horizontally about the perimeter to desired positions; it also defines the boundary of an inner support area.

Also shown in FIG. 3 is the interchangeable surface material 35 held in place by its own weight on the sheet of resilient molded material 30 and bordered by the channel 32 of the resilient molded material 30. Because the interchangeable surface material 35 is not physically fastened to the resilient molded material 30, it is easily removed, thereby facilitating quick replacement with other surfaces having desired texture and friction.

Figure 5:
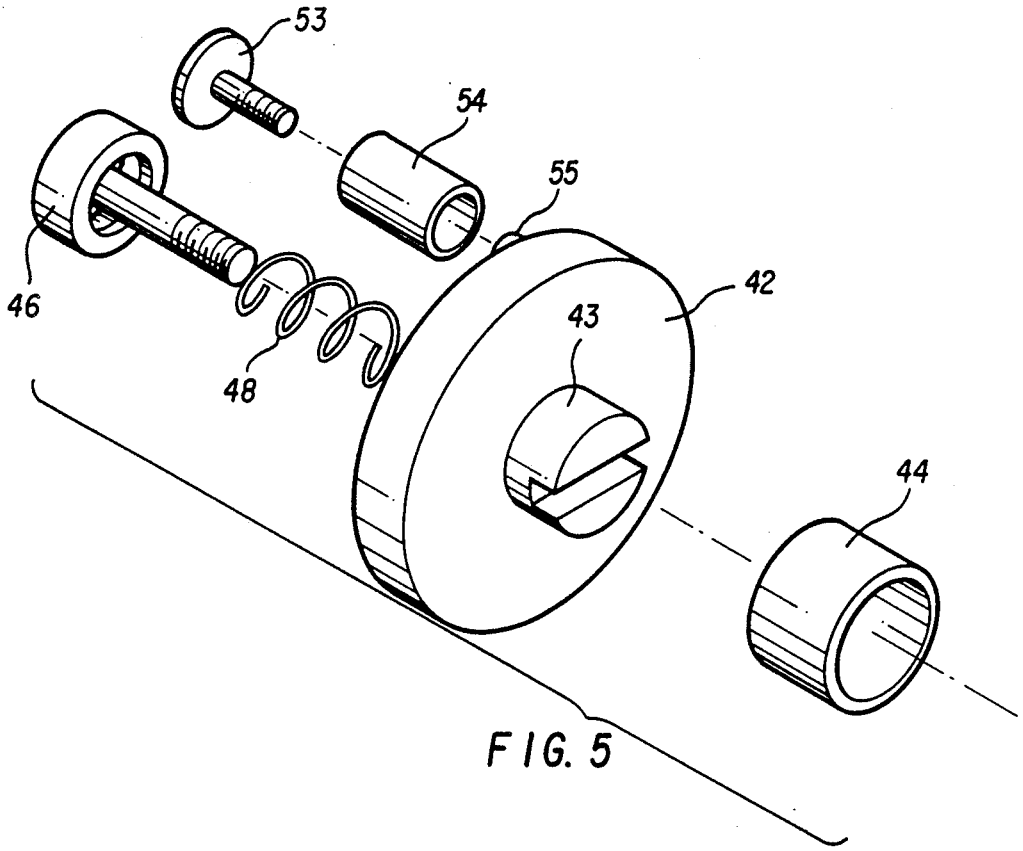
FIG. 5 is an exploded perspective view of the outer side of the elevation adjustment assembly.
Figure 6:
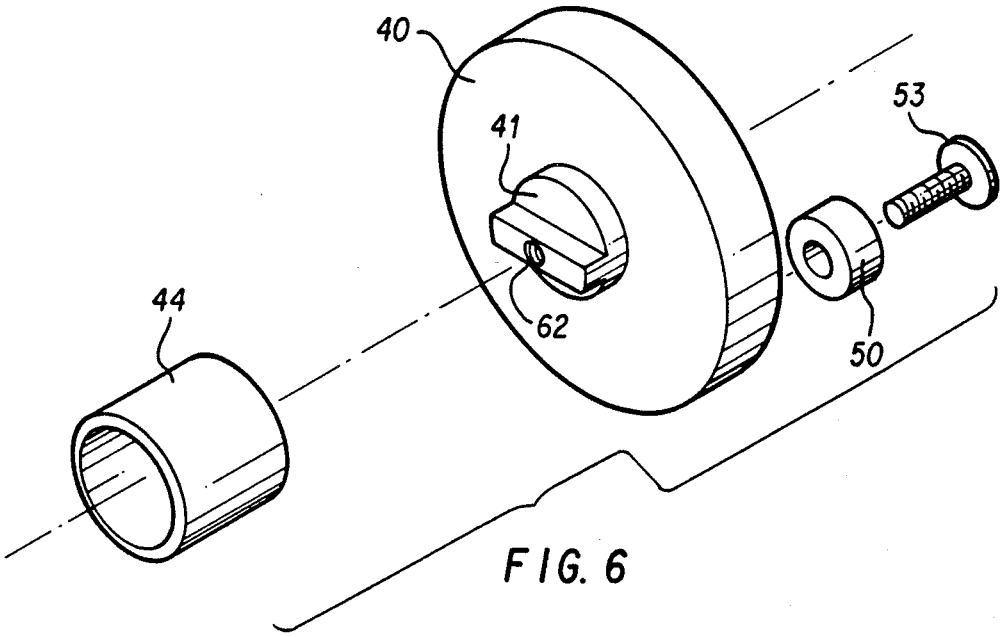
FIG. 6 is an exploded perspective view of the inner side of the elevation adjustment assembly.
Figure 7:
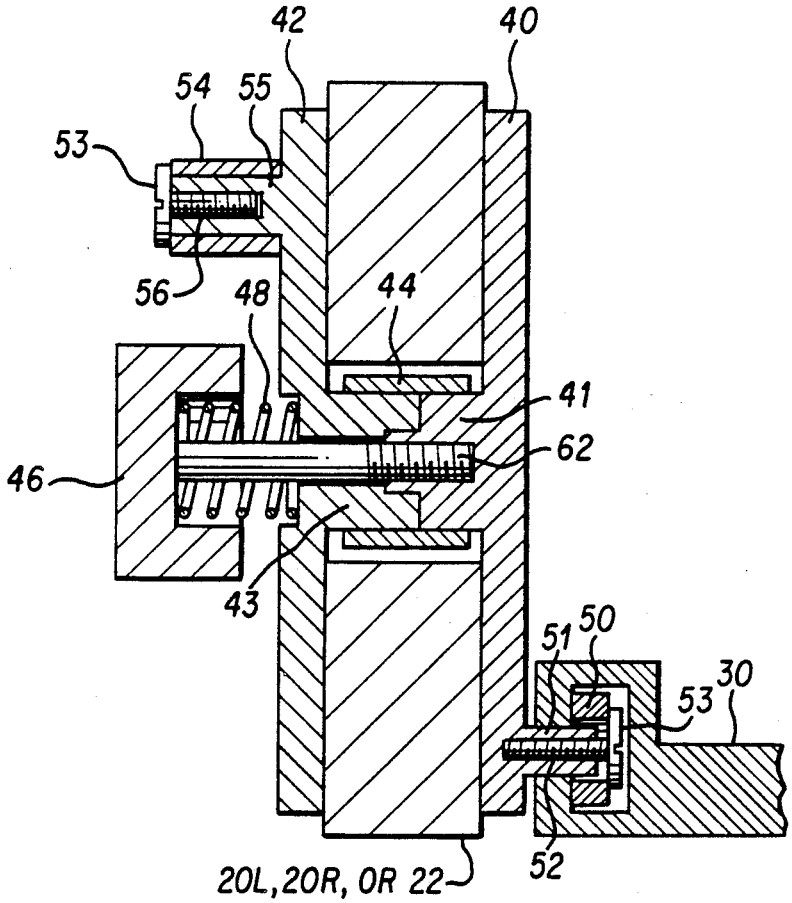
FIG. 7 is a cross-sectional view of the elevation adjustment assembly.
Figure 9:
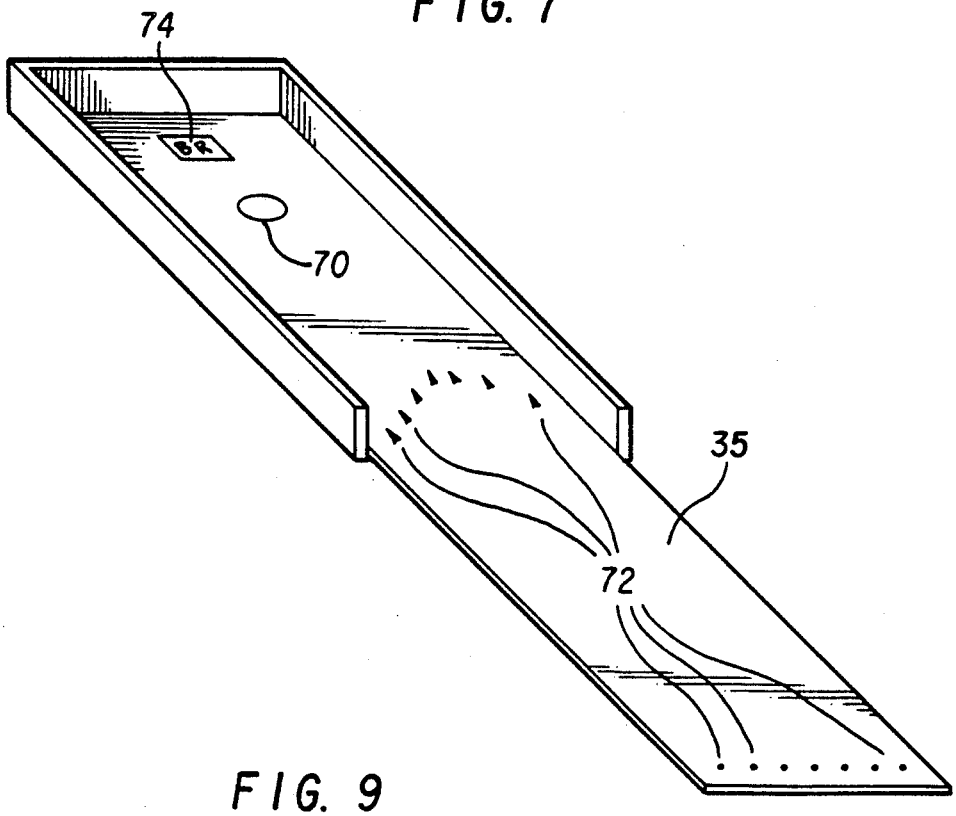
FIG. 9 is a perspective view of the interchangeable surface turf, or other suitable material without elevation adjustment assemblies showing calibrated reference points and a depression for a golf hole.
Figure 10:
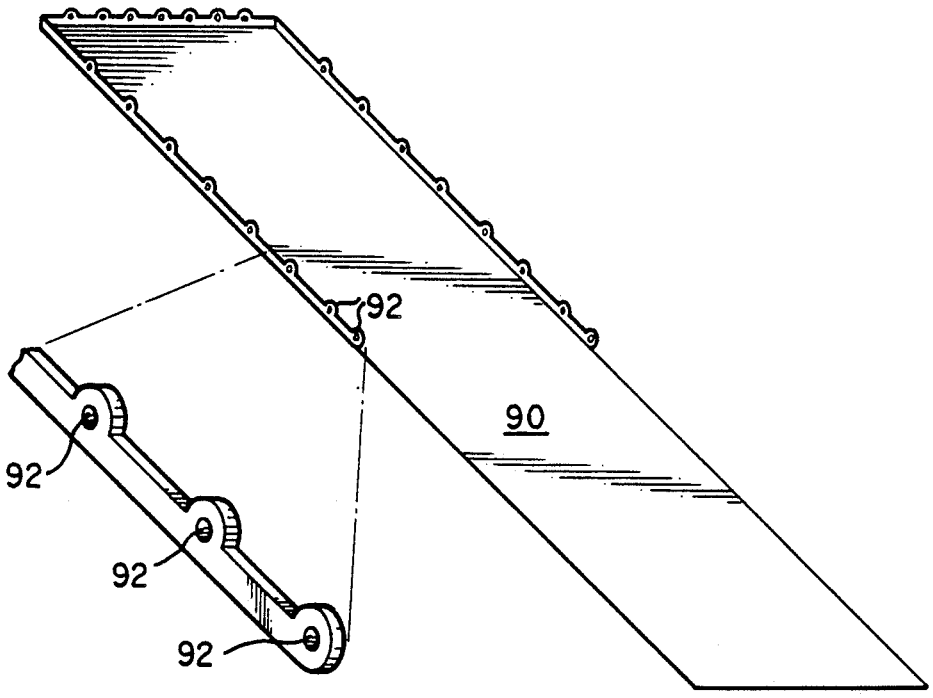
FIG. 10 is a perspective view of another version of the surface body that employs fixed positions for the elevation adjustments.
Figure 11:
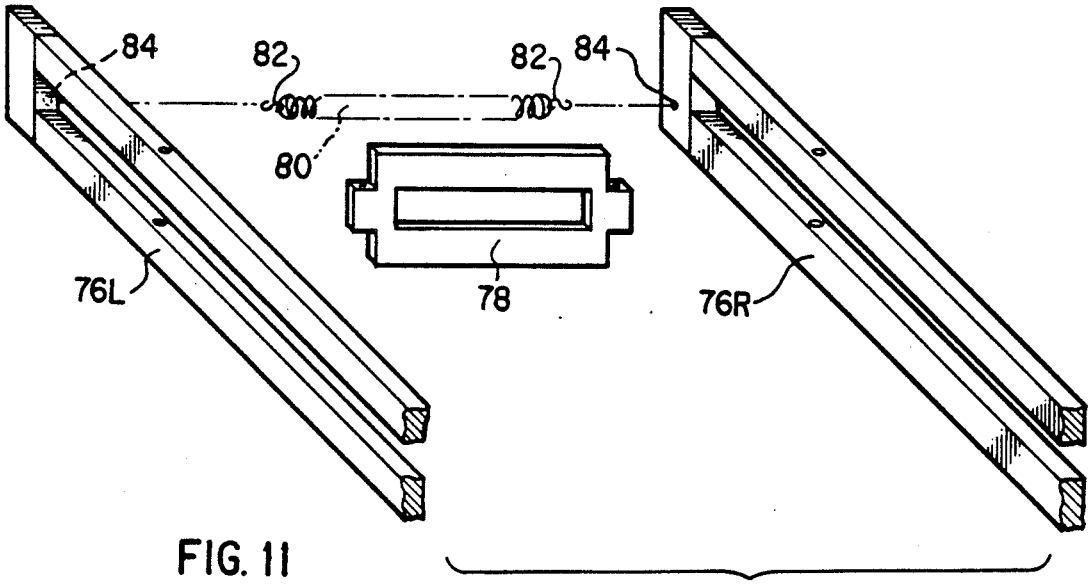
FIG. 11 is a perspective view of another version of the base assembly that employs a tension mechanism.
Figures 12, 13:
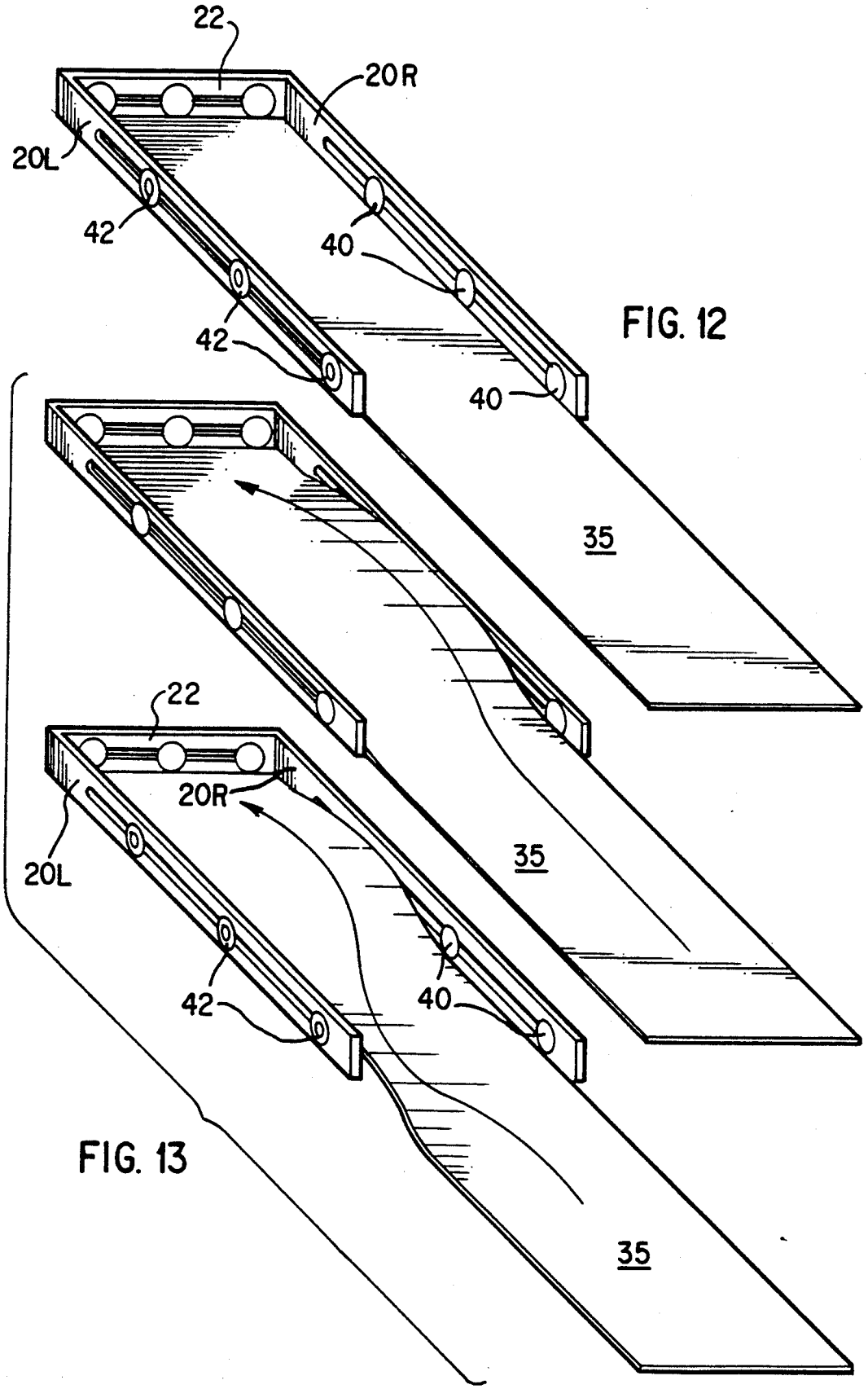
FIG. 12 is a perspective view of the complete apparatus shown in a level position.
Figure 15:
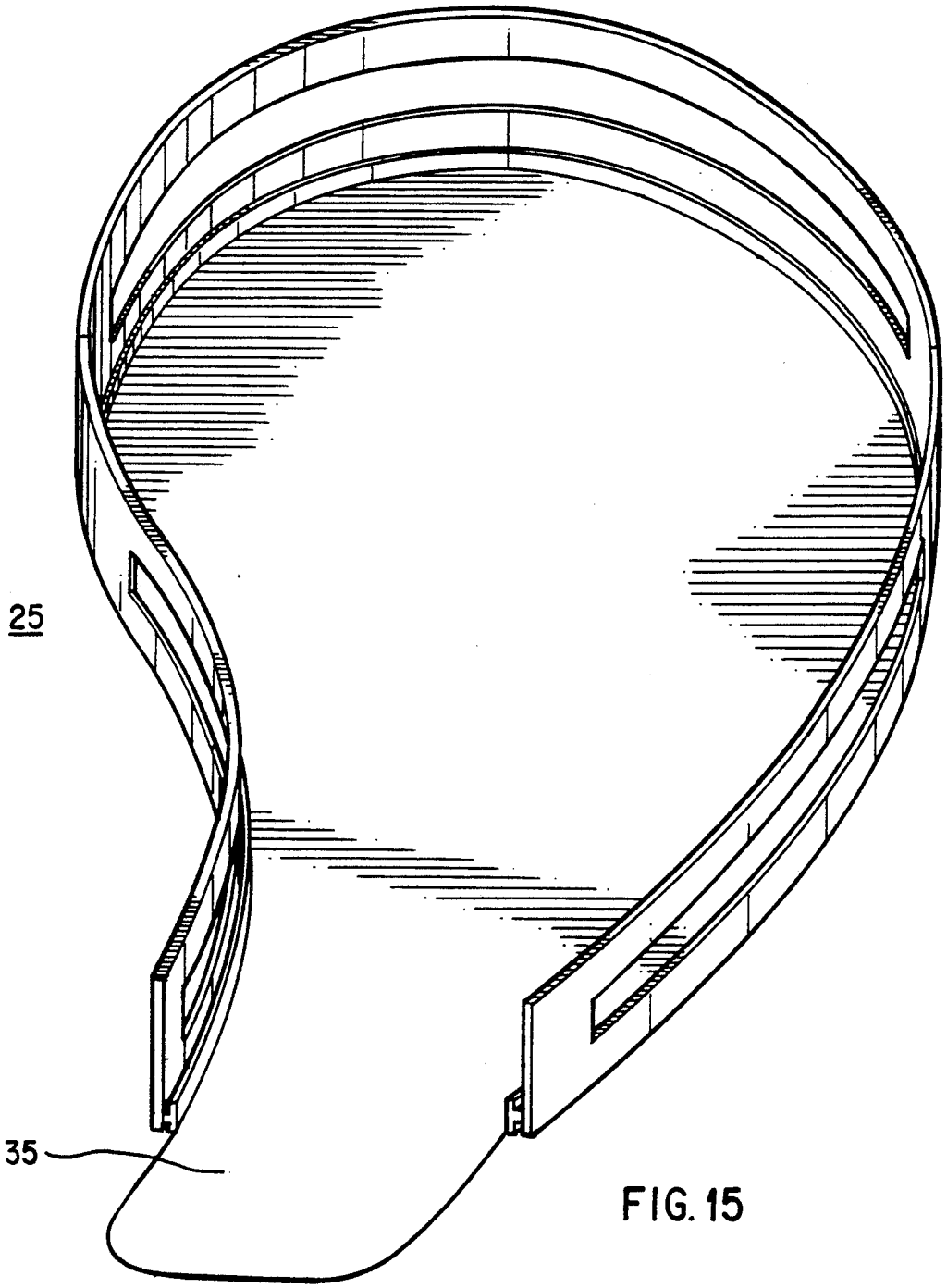
FIG. 15 is a perspective view of the apparatus shaped in the form of a kidney.
Figure 14:
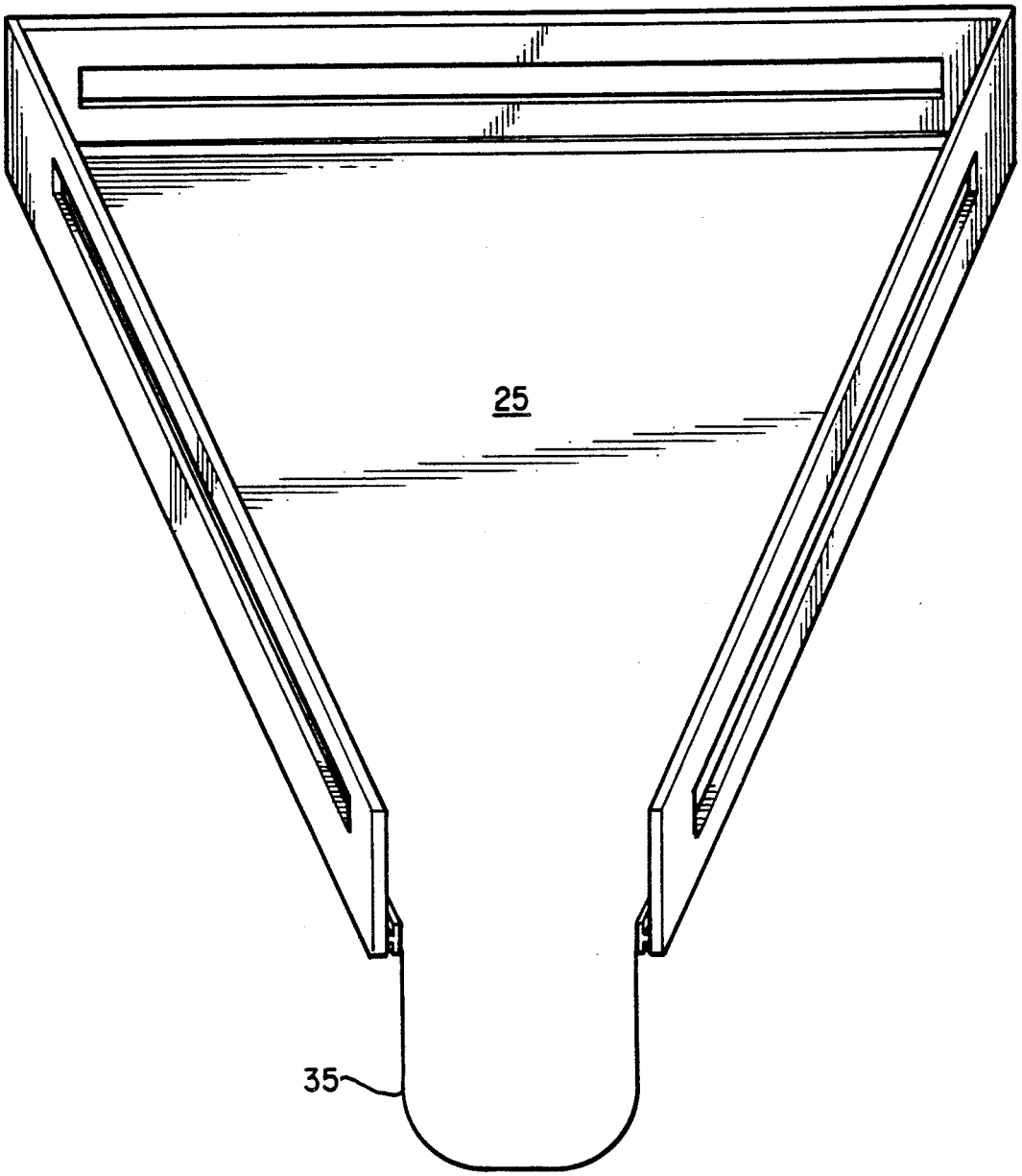
FIG. 14 is a perspective view of the apparatus shaped in the form of a triangle.
Figure 16:
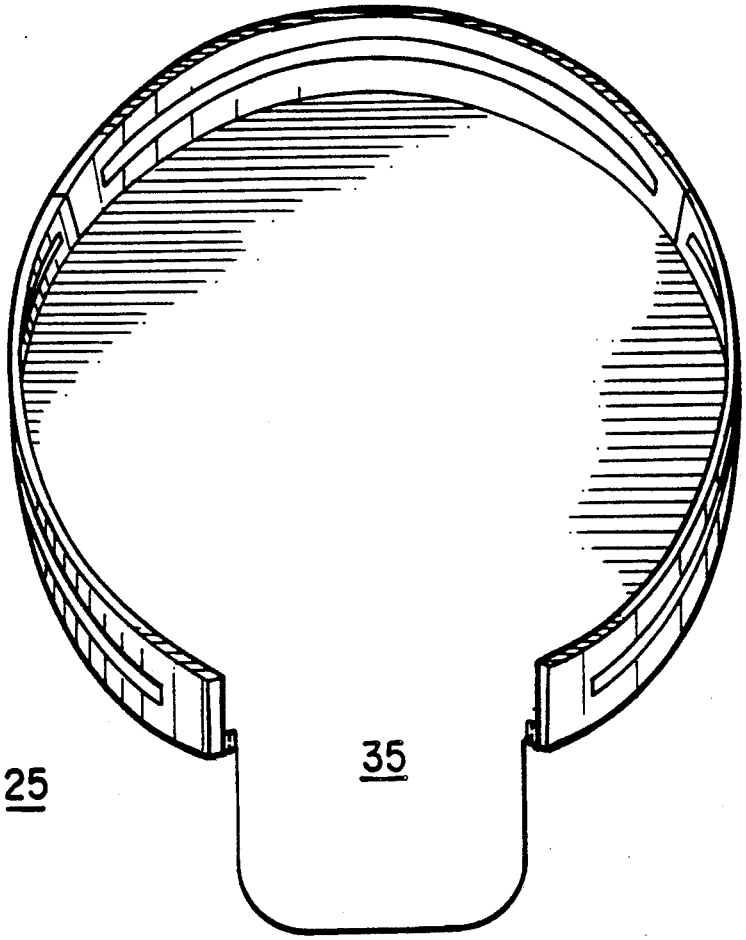
FIG. 16 is a perspective view of the apparatus shaped in the form of a circle.

As illustrated in FIG. 4, FIG. 5, FIG. 6 and FIG. 7, the elevation adjustment assembly 59 comprises an inner elevation adjuster 40 with outer elevation boss 43 attached at its rotational center and having an outer elevation boss slot 45 in its outer face. An adjuster hole 58 at the rotational center penetrates both the outer elevation boss 43 and the inner elevation adjuster 40 through which passes a threaded rod 47 of lock knob 46 which has a knob recess R3 around the threaded rod 47. A spring 48 is inserted over the threaded rod 47, into the knob recess 61, and also into a matched recess 60 in the outer elevation adjuster 42 around adjuster hole 58. The threaded rod 47 exits the outer elevation boss, passes through a main roller bearing 44 and threads into a threaded recess 62 in an inner elevation boss 41 attached to a inner elevation adjuster 40.

Inner elevation boss 41 has protrusion 49 matched to the outer elevation boss slot 45 into which it fits as the threaded rod 47 is tightened into threaded recess 62, forcing compression of the spring 48 which maintains outer elevation adjuster tightly in place. When thus assembled, the main roller bearing 44 is around the combination of outer elevation boss 43 and inner elevation boss 41. A main roller bearing 44 for each incorporation of an elevation adjustment assembly, is previously positioned in slot 24 of one of the base side panels or base end panels.

Attached near the outer perimeter of inner elevation adjuster 40 is inner elevation adjuster inner boss 51, with threaded hole 52, over which is placed inner roller bearing 50 and held in place by mounting screw 53A. The inner roller bearing is inserted into channel 30 of the sheet of resilient molded material which is thereby supported by several of such assemblies inserted and slidably attached.

While the threaded rod 47 is tightened, the spring pressure maintains pressure of outer elevation adjuster 42 and inner elevation adjuster 40 against the base side panel or base end panel on which it is mounted. Such pressure of the combined plurality of elevation adjustment assemblies severally mounted about the perimeter of the resilient molded material is sufficient to support the sheet of resilient molded material and the user. When lock knob 26 of an elevation adjustment assembly is pressed, in turn compressing the spring, pressure maintaining fixed position of the assembly is released and the assembly can be horizontally slid in a base side panel slot or a base end panel slot 24 and channel 32 of the resilient molded material 30 to a desired location.

Attached near the outer perimeter of outer elevation adjuster 42 is inner elevation adjuster inner boss 55, with threaded hole 56, over which is placed handle roller 54 having a hole through its center large enough for passage of inner elevation adjuster inner boss 55, and held in place by mounting screw 53A threaded into threaded hole 56.

Alternative to a slot 24 in the base side panels or base end panel can be a plurality of base holes 92 about the perimeter of the base side panels and base end panel which substitute main roller bearing 44 in the elevation adjustment assembly. Similar holes 92A can be substituted in the resilient molded material 30 for the channel 32. Horizontal adjustment in that embodiment is by removing the elevation adjustment assembly and reinstalling it in a preferred location or by having a plurality of elevation adjustment assemblies installed in all or substantially all of the base holes, a preferred contour being achieved by simply changing elevation positions of the elevation adjustment assemblies.

To modify the contour of the resilient molded material 30, the lock knob 46 is depressed and the height at a given elevation adjustment assembly is changed by a partial rotation of the outer elevation adjuster 42 which, in turn, rotates the inner elevation adjuster connected to the resilient molded material 30 causing vertical adjustment. Horizontal adjustment is also made with the lock knob 46 depressed and pressure released by sliding the released elevation adjuster assembly to the preferred horizontal position. When the preferred horizontal and vertical position is obtained for the elevation adjustment assembly, the lock knob 46 is released. The process is repeated for up to all of the elevation adjuster assemblies until the desired contour of the resilient molded material is as desired.

It is readily apparent that the provision for continuous adjustment both in horizontal and vertical dimensions allows for a very large number of contours. On any contour the interchangeable material 35 can be added or changed to closely approximate the playing conditions in texture and friction that a user might simulate as coupled with the customized contour of the resilient molded material supporting the interchangeable material.

I claim:

1. An adjustable golf practice putting surface comprising:

a sheet of resilient molded material of sufficient size to accommodate use by a human being for practicing putting;

a plurality of elevation adjustment devices;

distinct receiving means for receiving said elevation adjustment devices to enable both anchoring of, and free horizontal movement of said elevation adjustment devices along substantially the entire perimeter of said resilient molded material, whereby numerous changes in contour and undulation to said sheet of resilient molded material may be achieved.

2. An adjustable golf practice putting surface as in claim 1 further compromising an interchangeable surface material made of an artificial turf or other suitable material to simulate playing conditions of varying texture and friction, said interchangeable surface material being held in place by its own weight on top of said resilient molded material.

3. An adjustable golf practice putting surface as in claim 1 wherein said golf practice putting surface is rectangular in shape.

4. An adjustable golf practice putting surface as in claim 1 wherein said golf practice putting surface is circular in shape.

5. An adjustable golf practice putting surface as in claim 1 wherein said golf practice putting surface is triangular in shape.

6. An adjustable golf practice putting surface as in claim 1 wherein said golf practice putting surface is kidney shaped.

* * * * *